US008590336B2

(12) United States Patent
Cominski

(10) Patent No.: US 8,590,336 B2
(45) Date of Patent: Nov. 26, 2013

(54) COLD DRINK DISPENSER SYSTEM

(76) Inventor: Michael Cominski, Belmont, NC (US)

( * ) Notice: Subject to any disclaimer, the term of this patent is extended or adjusted under 35 U.S.C. 154(b) by 172 days.

(21) Appl. No.: 13/031,096

(22) Filed: Feb. 18, 2011

(65) Prior Publication Data

US 2012/0042682 A1 Feb. 23, 2012

Related U.S. Application Data

(60) Provisional application No. 61/313,930, filed on Mar. 15, 2010.

(51) Int. Cl.

| | |
|---|---|
| ***F25D 3/00*** | (2006.01) |
| ***F25C 1/22*** | (2006.01) |
| ***F25C 1/00*** | (2006.01) |

(52) U.S. Cl.

USPC ..... 62/398; 62/396; 62/389; 62/340; 62/137

(58) Field of Classification Search

USPC ..... 62/389, 340, 139, 330, 356, 460, 400, 62/396, 434, 437, 76; 222/146.6

See application file for complete search history.

(56) References Cited

U.S. PATENT DOCUMENTS

| | | | | |
|---|---|---|---|---|
| 3,775,992 | A * | 12/1973 | Bright | 62/73 |
| 3,827,256 | A * | 8/1974 | Wiesner | 62/330 |
| 4,187,262 | A | 2/1980 | Fessler et al. | |
| 5,487,492 | A | 1/1996 | Goulet | |
| 6,449,966 | B1 * | 9/2002 | Bethuy et al. | 62/139 |
| 6,725,687 | B2 | 4/2004 | McCann et al. | |
| 7,296,508 | B2 | 11/2007 | Hillyer | |
| 7,416,170 | B2 | 8/2008 | Jablonski et al. | |
| 2004/0068995 | A1 * | 4/2004 | Bethuy et al. | 62/139 |
| 2005/0072800 | A1 * | 4/2005 | Smith | 222/129.2 |
| 2008/0168791 | A1 * | 7/2008 | Nebbia et al. | 62/389 |

* cited by examiner

*Primary Examiner* — Frantz Jules
*Assistant Examiner* — Cassey D Bauer
(74) *Attorney, Agent, or Firm* — Ronald L. Hofer

(57) ABSTRACT

A system for dispensing cold beverages. The system has a sealed enclosure containing an ice bath with a cold plate immersed therein and an ice system having an ice maker with a control mechanism operatively connected to said ice maker to maintain a predetermined quantity of ice in said ice bath.

8 Claims, 1 Drawing Sheet

COLD DRINK DISPENSER SYSTEM

FIELD OF THE INVENTION

The present invention relates to a system for dispensing "bag in box" cold beverages. More particularly, the present invention relates to a system which is particularly well adapted for home use for dispensing cold carbonated "bag in box" beverages.

BACKGROUND OF THE INVENTION

So called "bag in box" (BIB) systems for delivering cold sodas, juices and other flavored drinks, are commonly used today in restaurants and other commercial establishments. BIB systems are used to dispense both carbonated and noncarbonated beverages but are generally found only in commercial establishments. BIB systems are rarely put into residential use because of their initial high cost and large size which raise a barrier to their purchase and installation in the home.

One of the necessary components of a BIB system is a device for cooling the beverage. While it is desirable to use a cooling device with noncarbonated beverages, the cooling device plays a vital role in keeping the carbon dioxide gas in a carbonated beverage after it has been released from the dispenser nozzle. Two types of cooling devices are commonly used: cold plates and water bath chillers. Since the inception of BIB systems, cooling devices have generally been relatively large, expensive, high volume designs intended for commercial applications.

It would be desirable to have a BIB cold beverage delivery system which could be economically manufactured and installed. It would be especially desirable to have a BIB cold beverage delivery system which was well adapted for residential use. It would be even more desirable if the system was relatively small and hence suitable for placement in locations which could not accommodate a larger system. Thus, it would be desirable to have a BIB design which employed a cooling device which was relatively small, inexpensive and well adapted for installation in a home kitchen cabinet. In short, it would be desirable to have a BIB cold beverage delivery system which was well adapted to be installed and used in a conventional home environment.

In accordance with the present invention, a remote cooling device for small beverage systems for home use is provided. The device uses cold plate cooling in combination with a self contained small counter top ice maker. The cold drink dispensing system of the present invention incorporates the cooling device and is small enough to easily fit in typical residential kitchen cabinet. The system of the present invention can be manufactured at a reasonable cost and is cost effective to use in the average home. These and other advantages will be apparent from the following disclosure and claims taken in conjunction with the accompanying drawings.

SUMMARY OF THE INVENTION

A system for delivery of carbonated beverages has an insulated sealed enclosure containing an ice bath, a cold plate cooled by the ice bath and a self-contained ice system. The self-contained ice system is a regulated system which draws water from within the enclosure to form ice for the ice bath.

DESCRIPTION OF THE INVENTION

Figure 1:
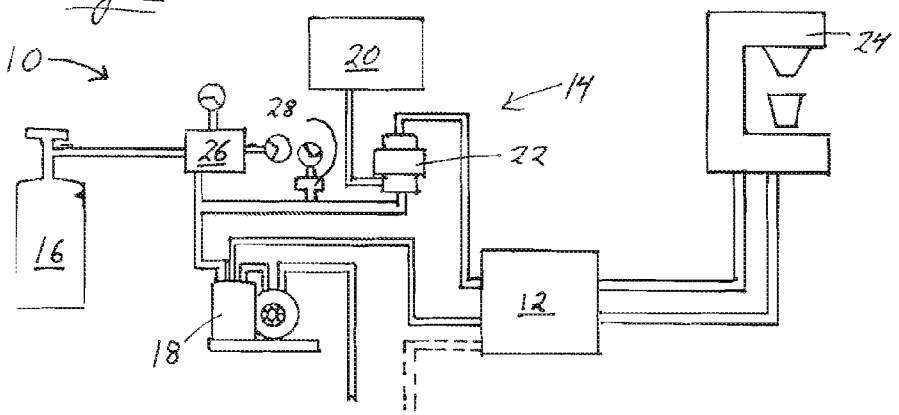
FIG. 1 is a schematic view illustrating the parts of a preferred embodiment of a cold drink delivery system of the present invention.
Figure 2:
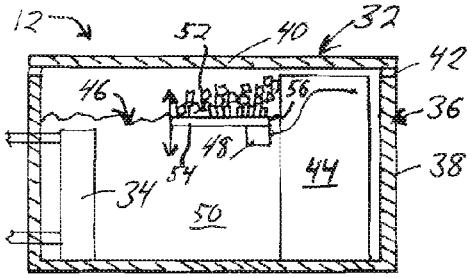
FIG. 2 is a cross-sectional view illustrating a preferred embodiment of a cooling device of the present invention.

Now referring to FIG. 1, a preferred embodiment of a system of the present invention is shown in schematic form and indicated generally by the numeral 10. System 10 is for the purpose of delivering carbonated beverages to a consumer or user and broadly speaking comprises cooling device 12 in combination with "bag in box" (hereinafter referred to as BIB) system 14. BIB system 14 comprises conventional components which are known for use in BIB systems including $CO_2$ tank 16, carbonator 18, bag in box 20, syrup pump 22 and dispenser 24. The interior of $CO_2$ tank 16 is in fluid communication with carbonator 18 and syrup pump 22 with primary and secondary regulators 26 and 28 respectively providing pressure regulation as is typical in the art. Syrup pump 22 pumps syrup from bag n box 20 into cooling device 12 where it is cooled as described in more detail below. Carbonator 18 provides soda water to cooling device 12 where it is cooled as described in more detail below. Cold syrup and soda water are supplied from cooling device 12 to dispenser 24 where a desired mixture is selected and dispensesd by the user in a conventional manner.

Cooling device 12 comprises ice system 32 and cold plate 34 both of which are contained in sealed container 36. Container 36 has enclosure 38 with removable lid 40. A sealing strip 42 serves to seal lid 40 to the top edge of enclosure 38. Enclosure 38 is thermally insulated for energy efficiency and is suitable to contain water and ice, i.e., an ice bath, without leaking.

Ice system 32 comprises ice maker 44, ice bath 46 and ice control 48. Ice system 32 is a sealed, self contained, cyclical system and is enclosed with cold plate 34 in sealed container 36. Ice bath 46 is comprised of water 50 and ice cubes 52. Ice bath 46 has the purpose of maintaining cold plate 34 at about 0° C. for cooling of soda water and syrup. It is intended that cooling device 12 is a "sealed" system which cycles water between its liquid and solid state. Thus, ice maker 44 draws water 50 from ice bath 46 in enclosure 38 and forms ice cubes 52 therefrom. Ice cubes 52 are ejected from ice maker 44 when commanded to do so by ice control 48 which selectively controls when ice is added to ice bath 46. Ice control 48 employs pressure plate 54 which is operatively connected to reed switch 56. When a predetermined amount of ice is supported by pressure plate 54, switch 56 is in an "off" position which controls ice maker 44 to a standby state in which ice maker 44 freezes water therein to make ice cubes but does not eject the ice cubes so made. During time in use, ice on pressure plate 54 will melt into ice bath 46 and reduce the weight of ice on pressure plate 54. When pressure plate 54 senses less than a predetermined amount of ice is thereon, switch 56 is put into an "on" position which controls ice maker 44 to a productive state wherein ice is dumped onto pressure plate 54 and water is drawn from ice bath 46 into ice maker 44 for conversion into ice. Ice is produced by ice maker 44 and dumped onto pressure plate 54 until a predetermined amount of ice is thereon at which time pressure plate 54 operates to put switch 56 into the "off" position which stops further ice production by ice maker 44. Ice system 32 thus operates to maintain the temperature of ice bath 46 at about 0° C. as ice cubes 52 are formed by ice maker 44 and dumped onto pressure plate 54, melts into the water 50 of ice bath 46 and is reformed from water 50 by ice maker 44 in a cyclical manner.

In operation, cold plate 34 is maintained at about 0° C. by ice bath 46 which is continuously maintained by recycling water 50 into ice cubes 52 under control of pressure plate 54 as describe above. Cold plate 34 serves the conventional function of cold plates to cool and carbonate a beverage passed therethrough as controlled by selector/dispenser valve 24. Cold plate 34 is supplied with soda water by carbonator 18 and syrup by syrup pump 22. Cold plate 24 supplies syrup and soda water to dispenser/selector valve 24 by which a user selects and dispenses a desired carbonated beverage.

Figure 3:
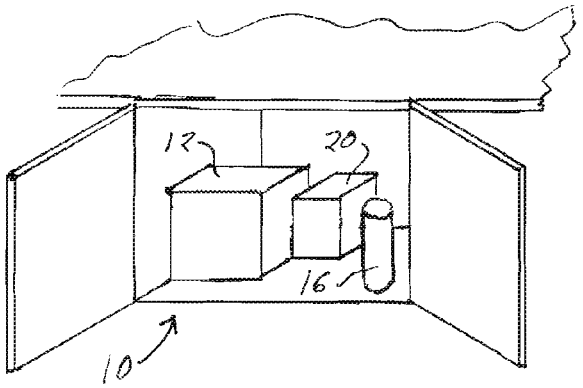
FIG. 3 is a perspective view, broken away, illustrating the system of FIG. 1 installed in a typical home kitchen base cabinet.

It will be appreciated by those skilled in the art that the present invention provides a system for delivery of carbonated beverages which has a small foot print and overall size and which is well suited for installation in a typical home kitchen cabinet as is illustrated in FIG. 3. Thus, system 10 has a height, width and depth which is less than the interior dimensions of a typical residential kitchen cabinet. It will also be appreciated that the preferred embodiment of the present invention described herein is subject to variation and/or modification and such variations and modifications are intended to be included within the broad scope of the present invention which is intended to be limited only by the scope of the following claims.

What is claimed is:

1. A cold drink dispensing system for dispensing carbonated beverages, the system comprising a cooling device having a sealed container having an interior containing an ice bath with a cold plate immersed therein, and an ice system having an ice maker and a control mechanism operatively connected to said ice maker to maintain a predetermined quantity of ice in said ice bath, said ice system being a self-contained cyclical system which draws water from within the enclosure to form ice for the ice bath;

wherein said control mechanism comprises a pressure plate immersed within said ice bath and connected to a switch to activate and deactivate said ice maker; and wherein when a predetermined amount of ice is supported by said pressure plate, said switch is in an "off" position, and said control mechanism controls said ice maker to a standby state in which said ice maker freezes water therein to make ice cubes but does not eject the ice cubes so made.

2. The system as in claim 1, wherein said cooling device, bag in box, carbon dioxide tank are disposed within a cabinet.

3. The system as in claim 2 wherein said switch is a reed switch.

4. A cold drink dispensing system for dispensing carbonated beverages, the system comprising a carbon dioxide tank, a carbonator, a bag in box and syrup pump, a cold drink dispenser, and a cooling device having a sealed container with an interior containing an ice bath comprising water and ice with a cold plate immersed therein and an ice system comprising an ice maker and a control mechanism having a pressure plate submerged in said water and connected to a reed switch which is responsive to a predetermined amount of ice on said pressure plate, said control mechanism operatively connected to said ice maker to maintain a predetermined quantity of ice in said ice bath; said bag in box, carbon dioxide tank and cooling device being disposed within a cabinet.

5. The system as in claim 4 wherein said ice quantity extends above said water in said ice bath when said control mechanism has placed ice onto said pressure plate.

6. The system as in claim 5 wherein said ice maker draws water from said ice bath for making said ice.

7. A cold drink dispensing system for dispensing carbonated beverages, the system comprising a cooling device having a sealed container having an interior containing an ice bath comprising water and ice with a cold plate immersed therein, and a self-contained, cyclical ice system which draws water from within the enclosure to form ice for the ice bath, having an ice maker and a control mechanism operatively connected to said ice maker to maintain a predetermined quantity of ice in said ice bath, said control mechanism comprises a pressure plate such that when said predetermined amount of ice is supported by said pressure plate, said switch is in an "off" position, and said control mechanism controls said ice maker to a standby state in which said ice maker freezes water therein to make ice cubes but does not eject the ice cubes so made; in said ice bath connected to a switch which is responsive to a predetermined amount of ice on said pressure plate said system further including a carbon dioxide tank, a carbonator, a bag in box and syrup pump, and a cold drink dispenser.

8. The system as in claim 7 wherein said ice quantity extends above said water in said ice bath when said control mechanism has placed ice onto said pressure plate.

* * * * *